US006247401B1

(12) United States Patent
Sato et al.

(10) Patent No.: US 6,247,401 B1
(45) Date of Patent: Jun. 19, 2001

(54) STENCIL PRINTER

(75) Inventors: Mitsuo Sato, Shibata-gun; Masayuki Shima; Tomoya Otomo, both of Sendai, all of (JP)

(73) Assignee: Tohoku Ricoh Co., Ltd., Miyagi (JP)

( * ) Notice: Subject to any disclaimer, the term of this patent is extended or adjusted under 35 U.S.C. 154(b) by 0 days.

(21) Appl. No.: 09/373,627

(22) Filed: Aug. 13, 1999

(30) Foreign Application Priority Data

Aug. 21, 1998 (JP) ..... 10-235878
Oct. 27, 1998 (JP) ..... 10-305344

(51) Int. Cl.[7] ..... B41L 13/06
(52) U.S. Cl. ..... 101/116; 101/120
(58) Field of Search ..... 101/116, 119, 101/120, 128.1

(56) References Cited

U.S. PATENT DOCUMENTS 3,949,666 * 4/1976 Zimmer ..... 101/120
3,965,817 * 6/1976 Ipek ..... 101/120
3,969,999 * 7/1976 Zimmer ..... 101/120
4,164,184 * 8/1979 Vertegaal ..... 101/127.1
5,081,924 * 1/1992 Ohinata ..... 101/116
5,095,816 * 3/1992 Hasegawa et al. ..... 101/119
5,213,032 * 5/1993 Van Akkeren et al. ..... 101/119

FOREIGN PATENT DOCUMENTS

3146256 * 6/1983 (DE) ..... 101/119
1-204781 8/1989 (JP) .
6-135111 5/1994 (JP) .
7-276773 10/1995 (JP) .
10-088806 4/1998 (JP) .

* cited by examiner

*Primary Examiner*—Stephen R. Funk
(74) *Attorney, Agent, or Firm*—Oblon, Spivak, McClelland, Maier & Neustadt, P.C.

(57) ABSTRACT

A stencil printer includes an ink drum having a hollow cylindrical porous support and a pair of flanges supporting opposite ends of the support. Annular elastic members are respectively affixed between the inner periphery of the porous support and the outer circumferences of the flanges. When the ink drum is pressed against a press roller, the elastic members deform and cause an ink roller disposed in the ink drum to be displaced. As a result, the ink roller contacts the inner periphery of the porous support brought into contact with and positioned by the press roller. The ink roller and the inner periphery of the ink drum can therefore contact each other under uniform pressure without the rigidity of the drum being reduced and without any shaking.

34 Claims, 18 Drawing Sheets

STENCIL PRINTER

BACKGROUND OF THE INVENTION

The present invention relates to a stencil printer for printing an image on a paper or similar recording medium via a master wrapped therearound.

There has been known a stencil printer of the type perforating a stencil with, e.g., a thermal head in accordance with image data, wrapping the perforated stencil or master around an ink drum and pressing a paper fed at a preselected timing against the ink drum with a press roller or similar pressing member, thereby printing an image on the paper. In this type of stencil printer, the ink drum includes a hollow shaft supported by opposite side walls of the printer body. A pair of flanges are rotatably mounted on the shaft. A hollow cylindrical porous support is supported by the flanges at opposite ends thereof. An ink roller and a doctor roller or similar ink feeding means are arranged in the ink drum.

When the press roller presses a paper against the outer periphery of the ink drum, the support deforms and contacts the ink roller at its inner periphery. As a result, ink sequentially penetrates into the pores of the support, mesh screens, and perforations formed in a master. The ink oozing out from the master is transferred to the paper, forming an image on the paper.

However, the problem with the above conventional stencil printer is that the inner periphery of the ink drum cannot be evenly pressed against the ink roller in the axial direction of the drum. Specifically, because the support is rigid, its opposite end portions supported by the flanges deform little, compared to the intermediate portion. As a result, the amount of ink fed and therefore image density is not uniform. This is particularly true when temperature is low, e.g., in winter.

In light of the above, the rigidity of the ink drum may be reduced to allow the porous support to deform easily, as proposed in the past. This, however, brings about another problem that the area over which the ink drum and press roller contact each other increases in proportion to the easiness of deformation, i.e., the ink drum turns with respect to the press roller by a greater angle, resulting in excessive ink transfer. More specifically, when the amount of ink transfer increases, the viscosity of the ink increases and causes the paper to adhere more strongly to the ink drum. As a result, the paper is apt to roll up by being entrained by the ink drum in rotation without being peeled off at a preselected position.

Japanese Patent Laid-Open Publication No. 1-204781 discloses a stencil printer capable of maintaining the shaft of an ink drum and that of a press roller at a preselected distance and causing an displaceable ink roller to press the drum against a press roller at the inside of the drum. In the printer taught in this document, a hollow cylindrical portion included in the ink drum is formed only of an elastic material in order to allow the drum to deform outward in a convex configuration. This allows the inner periphery of the ink drum to contact the ink roller under uniform pressure in the axial direction. However, the contact area over which the ink roller and the inner periphery of the ink drum pressed by the ink roller increases, again resulting in excessive ink transfer and therefor the roll-up of a paper.

The prerequisite with the stencil printer of the type described is therefore that irregular image density be obviated without reducing the rigidity of the ink drum. Japanese Patent Laid-Open Publication No. 7-276773 teaches a stencil printer having a specific configuration for meeting the above requirement. In the specific configuration, a rigid ink drum includes a rotary shaft portion greater in diameter than a support shaft or ink feed pipe, so that the ink drum is movable up and down. A press roller is positioned beneath the ink drum. While the ink drum is not pressed by the press roller, the upper end of the rotary shaft portion rests on the support shaft due to the weight of the ink drum. In this condition, a gap formed between the support shaft and the lower end of the rotary shaft portion is greater than a gap between the ink roller and the inner periphery of the ink drum.

When the above press roller is moved to press the ink drum, the drum is raised until its inner periphery contacts the stationary ink roller. Because the ink drum is rigid, the press roller and ink roller contact the drum in a condition adequate enough to obviate excessive ink transfer. Moreover, because the hollow cylindrical portion of the ink drum does not deform, contact pressure acts evenly between the ink drum and the inner periphery of the ink drum in the axial direction and obviates irregular image density.

Even the stencil printer taught in the above Laid-Open Publication No. 7-276773 has some problems left unsolved, as follows. The press roller must exert a force great enough not only to raise the ink drum but also to implement a printing pressure. This increases the size of a drive source for driving the press roller and aggravates power consumption. Further, the gap between the rotary shaft portion of the ink drum and the support shaft is likely to bring about shaking due to vibration during, e.g., delivery, damaging the structural parts of the printer.

Technologies relating to the present invention are also disclosed in, e.g., Japanese Patent Laid-Open Publication No. 6-135111 and Japanese Patent Application No. 10-88806.

SUMMARY OF THE INVENTION

It is therefore an object of the present invention to provide a stencil printer capable of obviating irregular image density and the roll-up of a paper without increasing the size of a drive source assigned to a press roller.

A stencil printer of the present invention includes a rotatable ink drum including a hollow cylindrical porous support. An ink roller is disposed in the ink drum. A pressing member is positioned outside of the ink drum and faces the ink roller for pressing a paper between the pressing member and the ink drum. A pair of elastic members allow the ink roller and porous support to be displaced independently of each other in a direction perpendicular to a shaft supporting the ink drum.

BRIEF DESCRIPTION OF THE DRAWINGS

The above and other objects, features and advantages of the present invention will become more apparent from the following detailed description taken with the accompanying drawings in which.

In the drawings, identical reference numerals designate identical structural elements.

DESCRIPTION OF THE PREFERRED EMBODIMENTS

Figure 1:
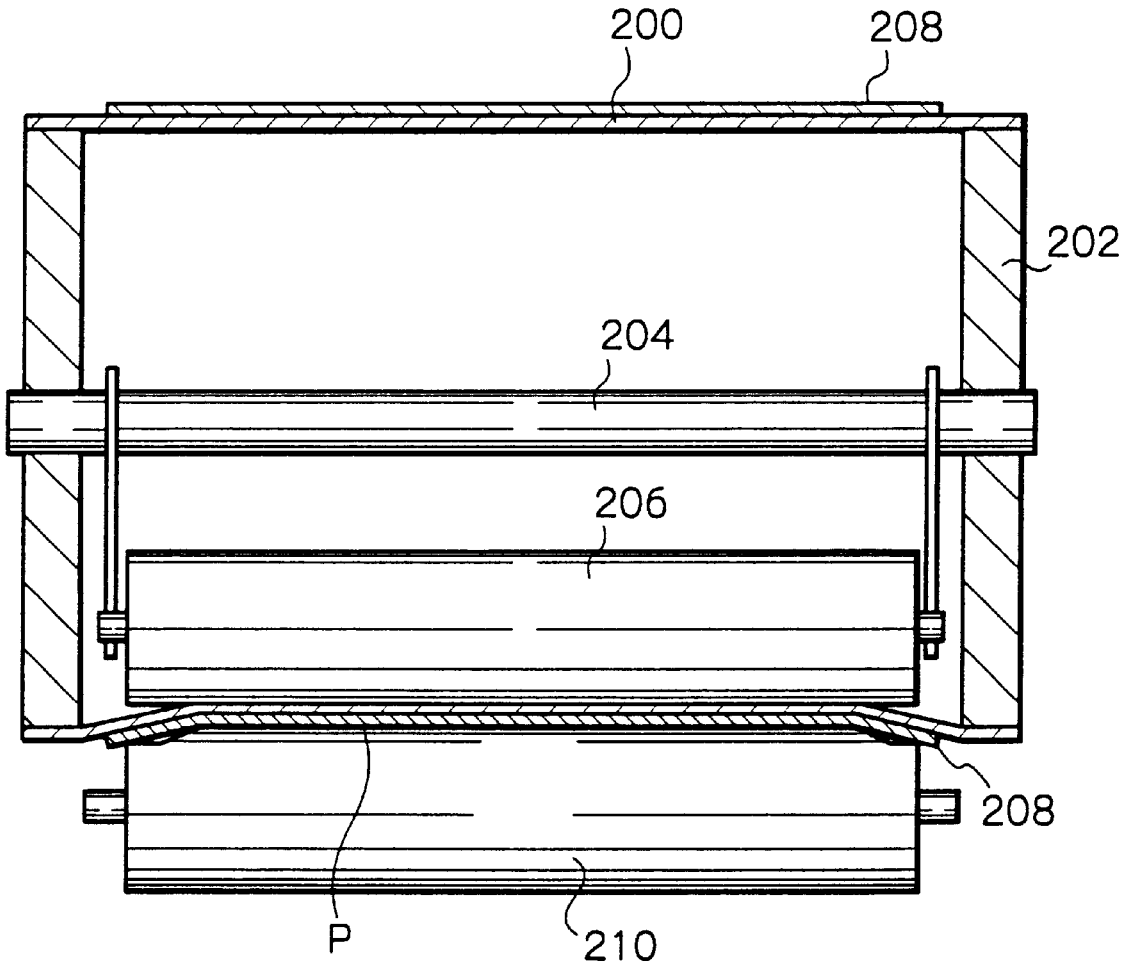
Fig. 1 PRIOR ART
FIG. 1 is a section showing essential part of a conventional stencil printer.

To better understand the present invention, brief reference will be made to a conventional stencil printer of the type making a master with, e.g., a thermal head in accordance with image data, wrapping it around an ink drum, and pressing a paper fed at a preselected timing against the ink drum with a press roller or similar pressing member. As shown in FIG. 1, the ink drum includes a hollow shaft 204 supported by the opposite side walls of the printer body not shown. A pair of flanges 202 are rotatably mounted on the shaft 204. A hollow cylindrical porous support 200 is supported by the flanges 202 at opposite ends thereof and constitutes the major part of the ink drum. Mesh screens are wrapped around the support 200 in one to three layers and implemented by thin wires of polyester or stainless steel. The mesh screens are used to promote the spread of ink and to hold a sufficient amount of ink. Generally, the support 200 is implemented by a thin sheet of stainless steel or similar material.

An ink roller 206 and a doctor roller or similar ink feeding means, not shown, are arranged in the ink drum. The ink roller 206 faces a press roller 210. The hollow shaft 204 plays the role of an ink feed pipe at the same time. Brackets are affixed to the shaft 204 and extend downward from the shaft 204, as illustrated. The ink roller 206 and doctor roller each are journalled to the brackets. A gap of about 0.3 mm to about 1 mm is formed between the outer periphery of the ink roller 206 and the inner periphery of the support 200, i.e., ink drum for the purpose of preventing ink from depositing on needless portions as well as for other purposes.

When the press roller 210 presses a paper P against the outer periphery of the ink drum, the support 200 deforms and contacts the ink roller 206 at its inner periphery. As a result, ink sequentially penetrates into the pores of the support 200, the mesh screens, and perforations formed in a master 208. The ink oozing out from the maser 208 is transferred to the paper P, forming an image on the paper P.

However, the problem with the above conventional stencil printer is that the inner periphery of the ink drum cannot be pressed against the ink roller 206 under uniform pressure in the axial direction of the drum, as discussed earlier. Specifically, because the support 200 is rigid, its opposite end portions supported by the flanges 202 deform little, compared to the intermediate portion. As a result, the amount of ink fed and therefore image density is not uniform. This is particularly true when temperature is low, e.g., in winter.

While some different schemes have heretofore been proposed in order to solve the above problem, each of them brings about another problem, as also discussed earlier.

Figure 2:
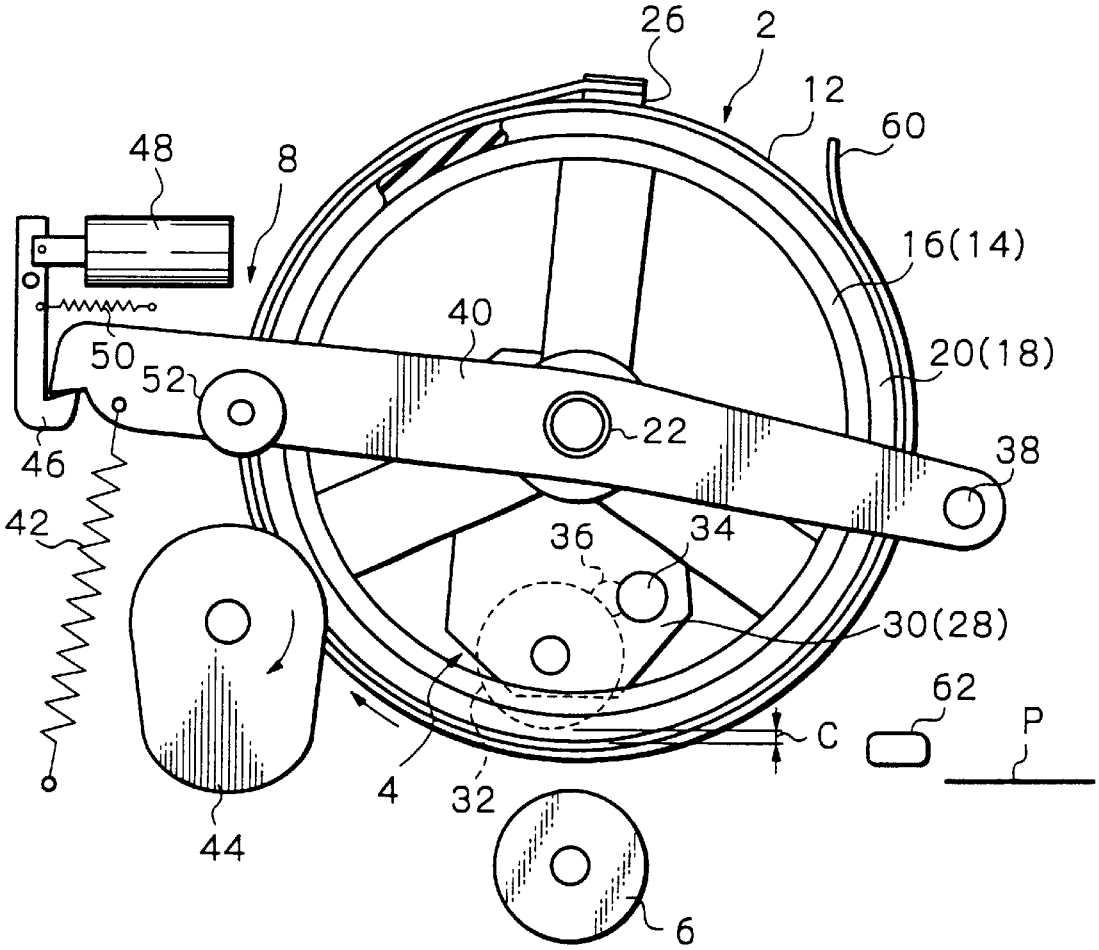
FIG. 2 is a fragmentary front view showing a stencil printer embodying the present invention.
Figure 3:
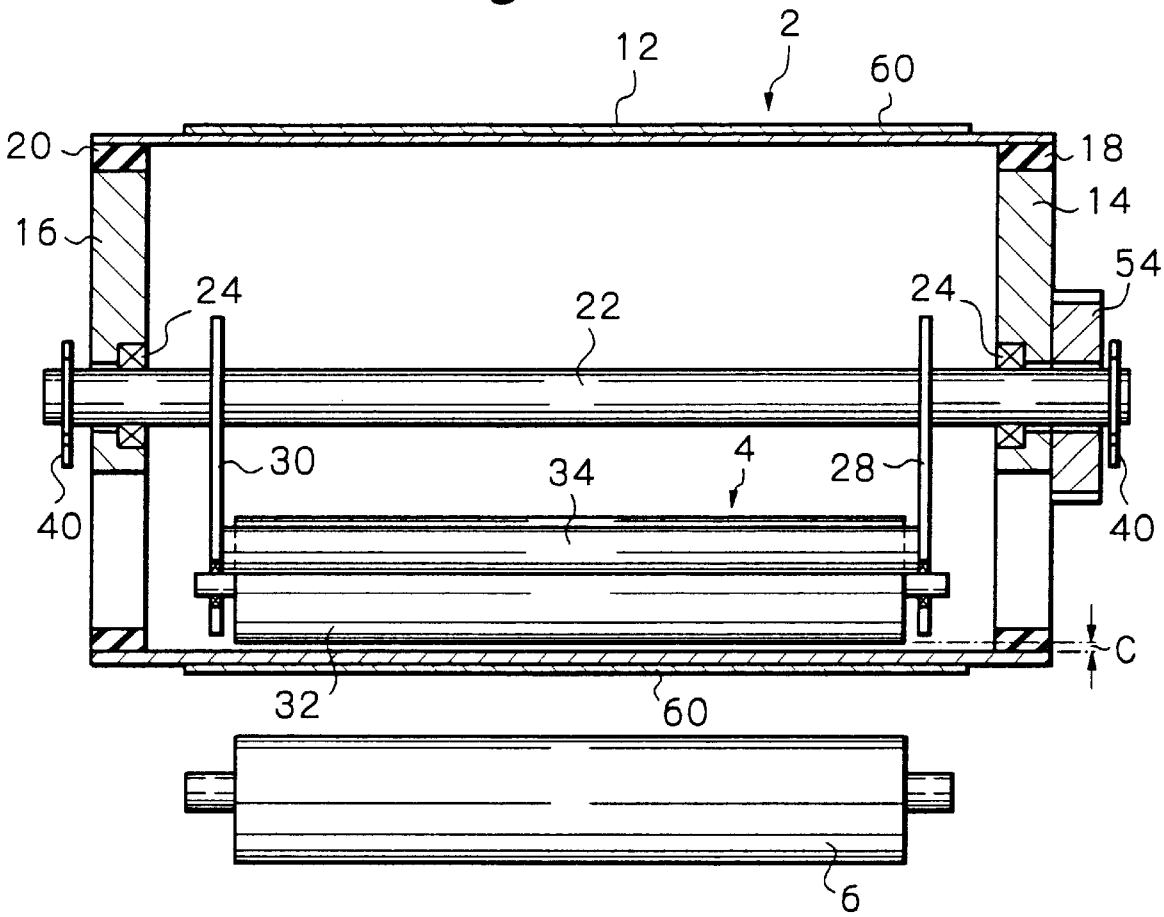
FIG. 3 is a side elevation showing an ink drum included in the illustrative embodiment.
Figure 4:
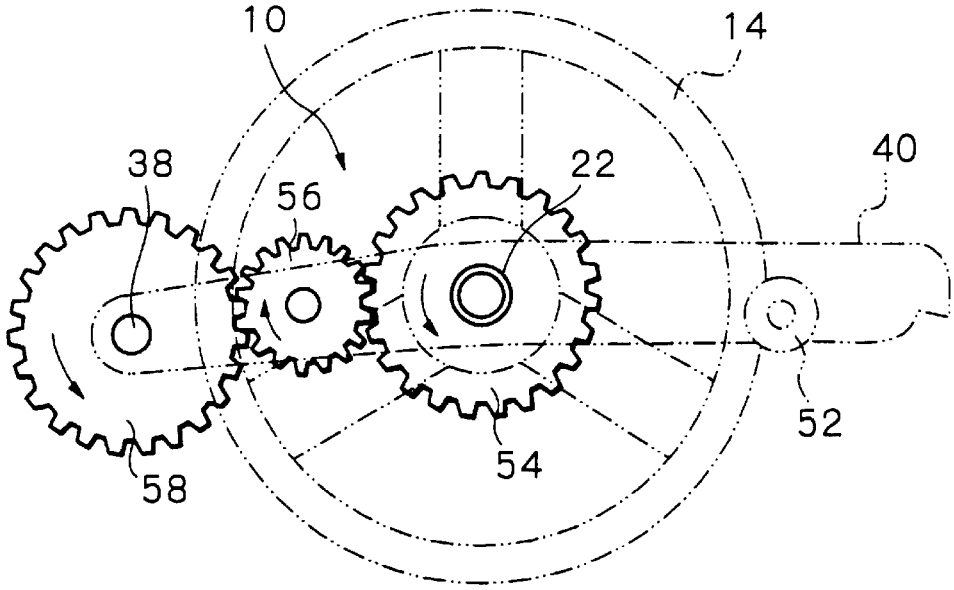
FIG. 4 is a rear view of a mechanism for driving the ink drum shown in FIG. 3.

Referring to FIGS. 2–4, a stencil printer embodying the present invention will be described. As shown, the stencil printer includes an ink drum 2 having the ink feeding means 4 arranged there inside. A rotatable press roller or pressing member 6 is positioned substantially beneath the ink drum 2 and spaced from the drum 2. Moving means 8 causes the ink drum 2 to selectively move into or out of contact with the press roller 6. A drive mechanism 10 causes the ink drum 2 to rotate. These members and mechanisms 2–10 constitute a printing section in combination. Other various sections including a master making section, a master feeding section, a paper feeding section, a master discharging section and a paper discharging section are, of course, arranged in the stencil printer. The sections other than the printing section may each be provided with a conventional configuration and will not be shown or described specifically. This is also true with the other embodiments to follow.

The ink drum 2 mainly consists of a hollow cylindrical porous support 12, a pair of flanges 14 and 16 supporting opposite ends of the support 12, and annular elastic members 18 and 20. The support 12 is formed with pores for passing ink except for a preselected portion thereof (non-porous portion hereinafter). The elastic members 18 and 20 are respectively affixed between the outer circumferences of the flanges 14 and 16 and the inner periphery of the support 12. A hollow shaft 22 is journalled to a pair of arms 40 which will be described specifically later. The flanges 14 and 16 are rotatably mounted on the shaft 22 via bearings 24. In this configuration, the entire ink drum 2 is rotatably mounted on the shaft 22. The support 12 is implemented by a thin sheet of stainless steel.

Mesh screens, not shown, are wrapped around the support 12 in one to three layers and implemented by thin wires of polyester or stainless steel. A perforated stencil or master 60 is wrapped around the outermost surface of the laminate mesh screens. A flat stage is formed in the non-porous portion of the support 12 while a clamper 26 is mounted on the stage. The clamper 26 is closed when it should clamp the leading edge of the master 60.

The ink feeding means 4 mainly consists of the shaft or ink feed pipe 22, brackets 28 and 30 extending downward from the shaft 22, an ink roller 32 journalled to the brackets 28 and 30 via bearings, and a doctor roller 34 affixed to the brackets 28 and 30. The ink roller 32 is located to face the press roller 6. As shown in FIG. 3, when pressure does not act on the ink drum 2, a clearance C exists between the outer periphery of the ink roller 32 and the inner periphery of the ink drum 2, i.e., support 12. In the illustrative embodiment, the clearance C is selected to be about 0.3 mm to about 1 mm.

As shown in FIG. 2, the ink roller 32 and doctor roller 34 form a wedge-shaped space or ink well 36 therebetween. Ink dropping from the shaft 22 accumulates in the ink well 36. The ink is fed from the ink well 36 to the surface of the ink roller 32 while being regulated to a preselected thickness by the doctor roller 34. When the ink roller 32 contacts the inner periphery of the ink drum 2, the ink is transferred from the former to the latter.

In the illustrative embodiment, the drum 2 is moved into and out of contact with the press roller 6. The press roller 6 is therefore rotatably supported by opposite stationary members not shown. The moving means 8 includes the previously mentioned two arms 40 each being rotatably mounted on a shaft 38 at one end and rotatably mounted on the shaft 22 at the intermediate portion. The shaft 38 is supported by opposite side walls, not shown, included in the printer. A spring 42 constantly biases the ink drum 2 toward the press roller 6 via the associated arm 40. A cam 44 drives the associated arm 40. A lock lever 46 selectively locks or unlocks the free end of the associated arm 40. A solenoid 48 drives the associated lock lever 46. A spring 50 constantly biases the associated lock lever 46 toward a locking position.

A cam follower 52 is mounted on the free end portion of each arm 40. The cam 44 drives the arm 40 when brought into contact with the cam follower 52. It is to be noted that identical moving means 8 each including the above structural elements are arranged at both sides of the ink drum 2.

As shown in FIGS. 3 and 4, the drive mechanism 10 includes a gear 54 affixed to the outer surface of one flange 14 and rotatable integrally with the flange 14. An intermediate gear 56 is rotatably mounted on the arm 40 adjoining the flange 14 an is held in mesh with the gear 54. A drive gear 58 is rotatably mounted on the shaft 38 and held in mesh with the intermediate gear 56. A motor, not shown, is affixed to the body of the printer. The output torque of the motor is transferred to the gear 58, so that the ink drum 2 is caused to rotate in the direction indicated by an arrow.

The above stencil printer is operated as follows. FIG. 2 shows the ink drum 2 held in a stand-by state with the master 60 being wrapped therearound. In this condition, the arm 40 is locked by the lock lever 46. In FIG. 2, the reference numeral 62 designates a paper sensor.

Figure 5:
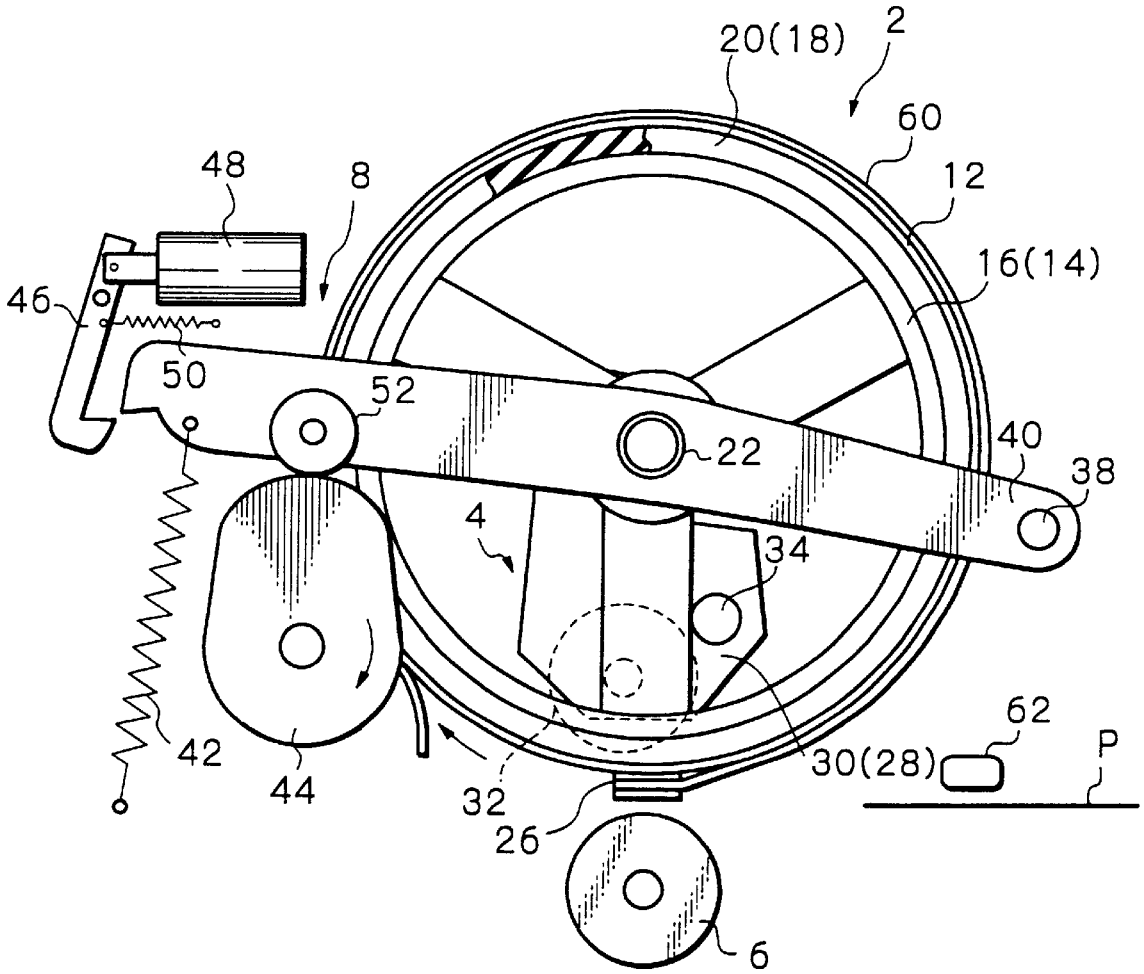
FIG. 5 is a front view showing the illustrative embodiment held in a stand-by condition.

A paper P is fed from the paper feeding section, not shown, in synchronism with the rotation of the ink drum 2. The cam 44 is rotated in synchronism with the drum 2 in the direction indicated by an arrow, pushing the cam follower 52 upward. As a result, a gap is formed between the arm 40 and the lock lever 46, as shown in FIG. 5. When the paper sensor 62 senses the leading edge of the paper P, the solenoid 48 is turned on to retract the lock lever 46 with the result that the arm 40 is unlocked.

Figure 6:
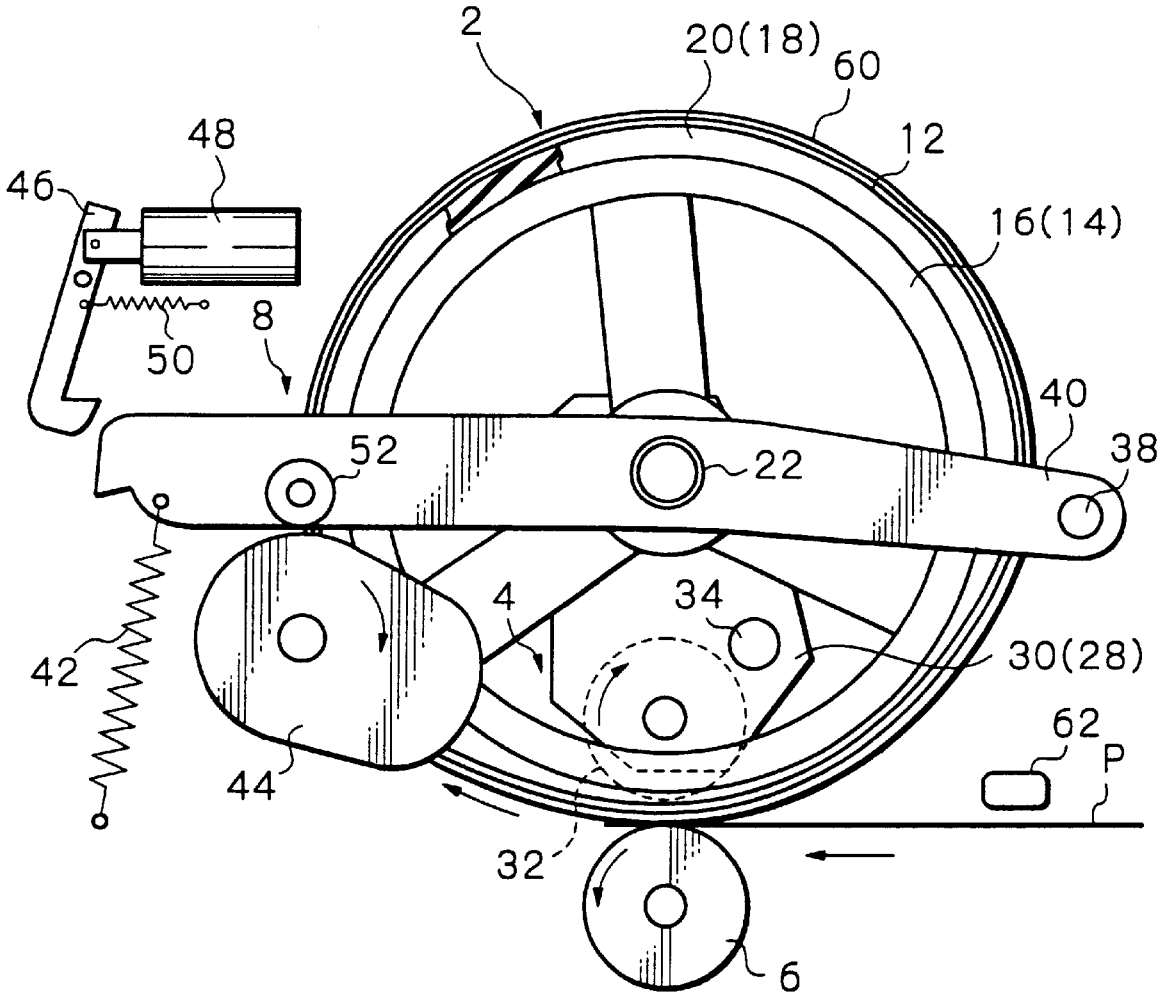
FIG. 6 is a front view showing the illustrative embodiment having started a printing operation.
Figure 7:
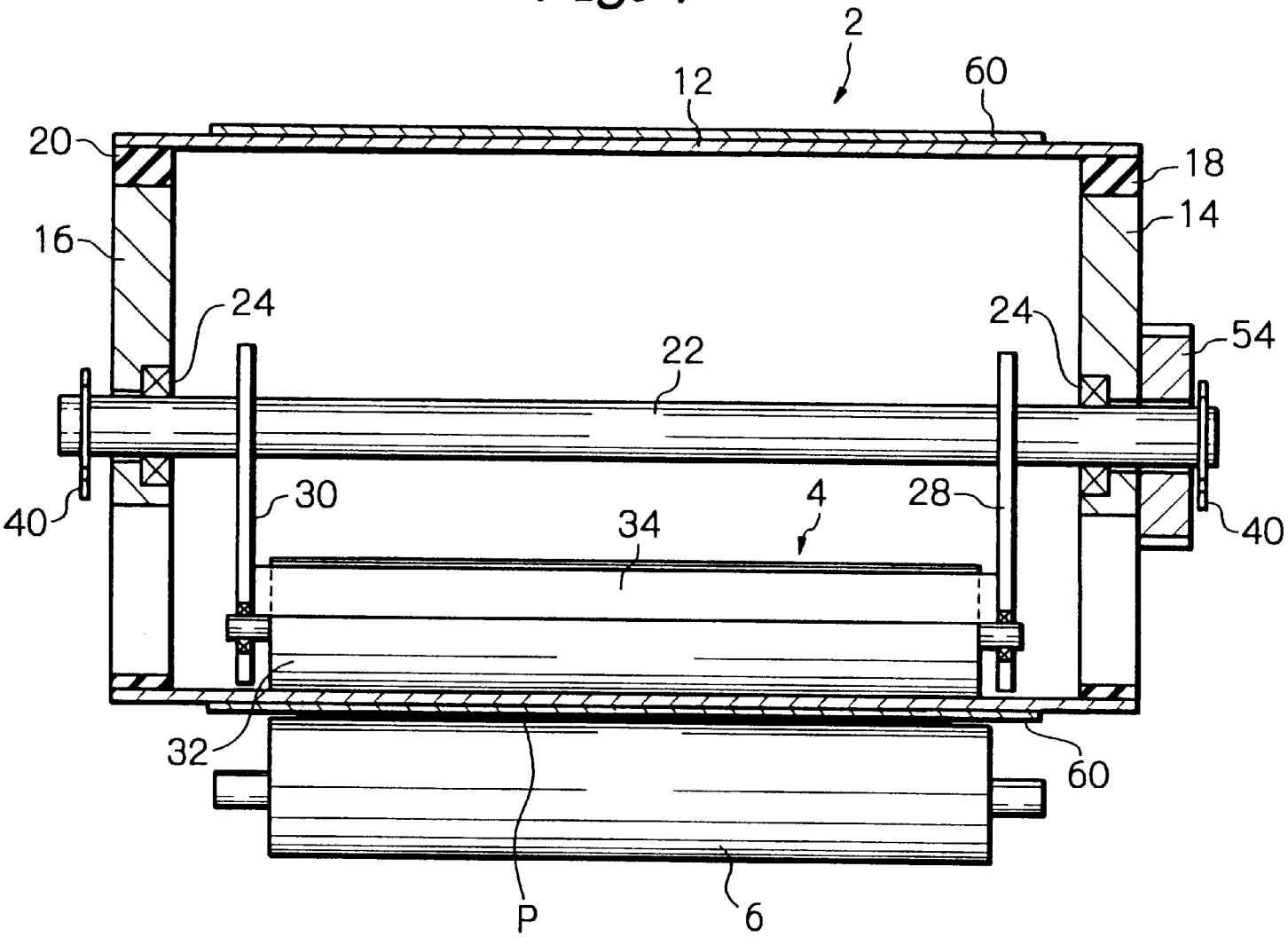
FIG. 7 is a side elevation showing the same condition as FIG. 6.

As shown in FIGS. 6 and 7, when the ink drum 2 and cam 44 are further rotated, the arm 40 rotates downward about the shaft 38 under the action of the spring 42 and causes the ink drum 2 to start contacting the press roller 6. At this instant, the ink drum 2 contacts the press roller 6 at such a timing that it does not interfere with the clamper 26. The paper P is brought to the nip between the ink drum 2 and the press roller 6 at the time when the ink drum 2 contacts the press roller 6.

As the cam 44 is further rotated, the cylindrical portion of the ink drum 2 including the porous support 12 is brought into contact with and positioned by the press roller 6. Consequently, the annular elastic members 18 and 20 are compressed and vary the dimension of the above cylindrical portion. The ink roller 32 is therefore displaced in the direction perpendicular to the shaft 22 until it contacts the inner periphery of the ink drum 2. The resulting friction acting between the ink roller 32 and the ink drum 2 causes the ink roller 32 to rotate in the same direction as the ink drum 2, as seen at the contact position. As a result, the ink is continuously fed from the ink roller 32 to the inner periphery of the ink drum 2.

The ink fed to the inner periphery of the support 12 penetrates into the mesh screens via the pores of the support 12 and then oozes out via the perforations of the master 60 due to the pressure acting between the ink drum 2 and the press roller 6. Consequently, the ink is transferred from the ink drum 2 to the paper P, forming a desired image on the paper P. The paper P with the image, i.e., a printing has its leading edge separated from the surface of the ink drum 2 by a peeler, not shown, and is conveyed to the paper discharging section not shown.

Because the entire cylindrical portion of the ink drum 2 is rigid, it turns with respect to each of the ink roller 32 and press roller 6 by an adequate angle. This prevents the paper P from rolling up due to an excessive amount of ink transfer. In addition, the ink roller 32 and the inner periphery of the ink drum 2 contact each other under uniform pressure in the axial direction, insuring uniform image density.

After the printing of the image on the paper P, the arm 40 is again pushed up by the cam 44 and cancels the pressure acting between the ink drum 2 and the press roller 6. As a result, the elastic members 18 and 20 are elastically restored to their original positions and again form the clearance C between the ink roller 32 and the ink drum 2. The solenoid 48 is turned off, in synchronism with the rotation of the ink drum 2, causing the lock lever 46 to return to the locking position under the action of the spring 50. Therefore, the free end of the arm 40 moving upward is resiliently locked by the lock lever 46. Consequently, the ink drum 2 is again held in its stand-by position.

The elastic members 18 and 20 each are an annular molding of rubber having low hardness. The hardness of the elastic members 18 and 20 is so determined by experiments as to satisfy the following conditions. When the members 18 and 20 are free from an external force (pressing force), they serve as spacers for maintaining the clearance between the ink roller 32 and the inner periphery of the ink drum 2, i.e., serve as structural members of the ink drum 2 having a fixed form. When an external force acts on the members 18 and 20, the members 18 and 20 deform.

The outer circumferences of the flanges 14 and 16 and the inner circumferences of the ink drum 2 have curvatures defining concentric circles. Therefore, the pressing force acts only locally in a line-to-line contact fashion and allows the elastic members 18 and 20 to easily deform only locally despite their annular configuration. This makes it possible to provide the members 18 and 20 with hardness high enough to serve as spacers and therefore to obviate shaking.

In the illustrative embodiment, the ink drum 2 is pressed against the stationary press roller 6 from above the roller 6. This eliminates the need for a force for lifting the press roller taught in Japanese Patent Laid-Open Publication No. 7-276773 mentioned earlier. Further, because the weight of the ink drum 2 acts in such a direction that it compresses the elastic members 18 and 20, the spring 42 needs only a small spring constant and can therefore be small size.

Of course, an arrangement may be made such that the press roller 6 is movable into and out of contact with the ink drum 2 which is stationary. In such an arrangement, the rigid cylindrical portion of the ink drum 2 is displaced in the direction perpendicular to the shaft 22 without any deformation in accordance with the deformation of the elastic members 18 and 20. This is also successful to set up uniform contact between the ink drum 2 and the ink roller 32.

For the elastic members 18 and 20, use may be made of urethane foam or similar foam plastics in place of rubber having low hardness. Even such materials each can be easily implemented as an annular molding. If desired, each annular molding may be replaced with a plurality of blocks arranged at equally spaced locations along the circumference and implemented by, e.g., coil springs.

Figure 8:
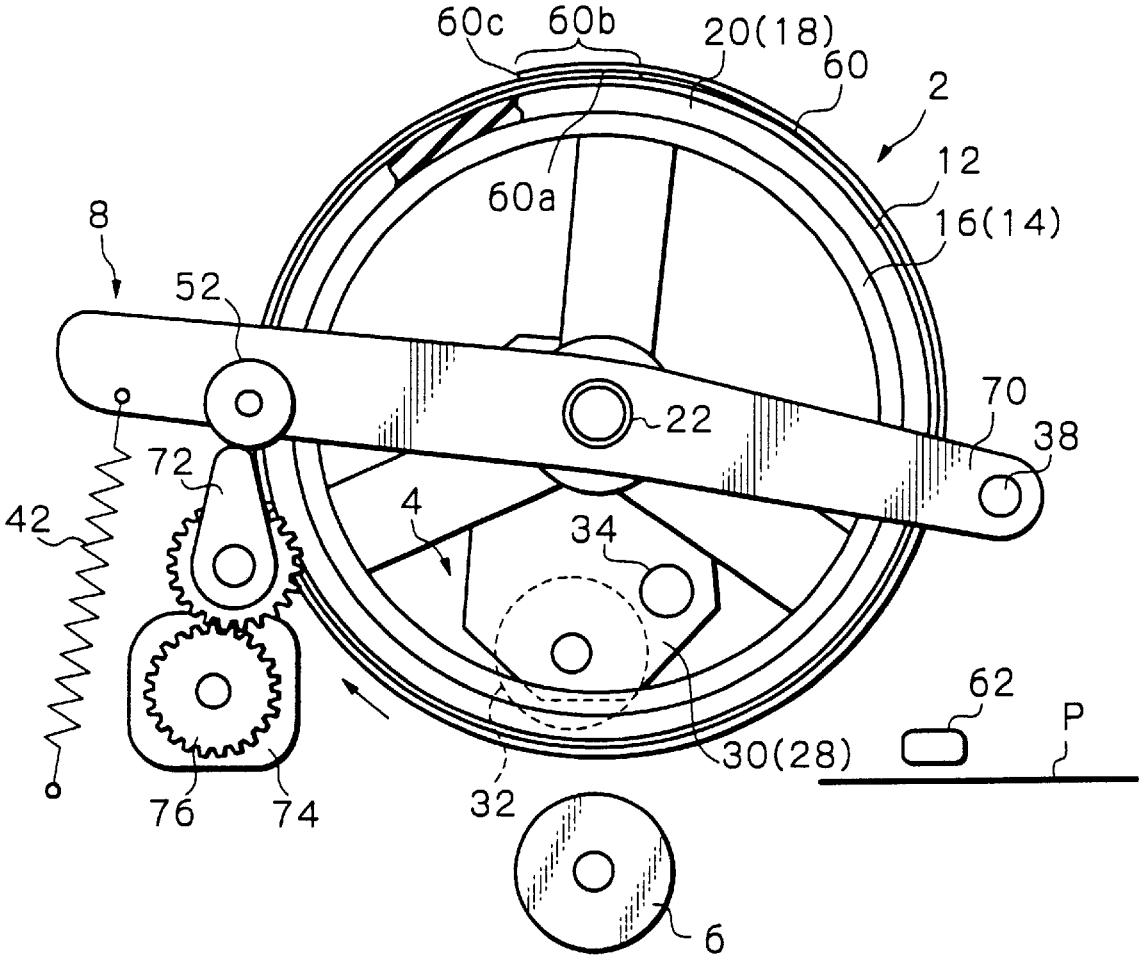
FIG. 8 is a fragmentary front view showing an alternative embodiment of the present invention.
Figure 9:
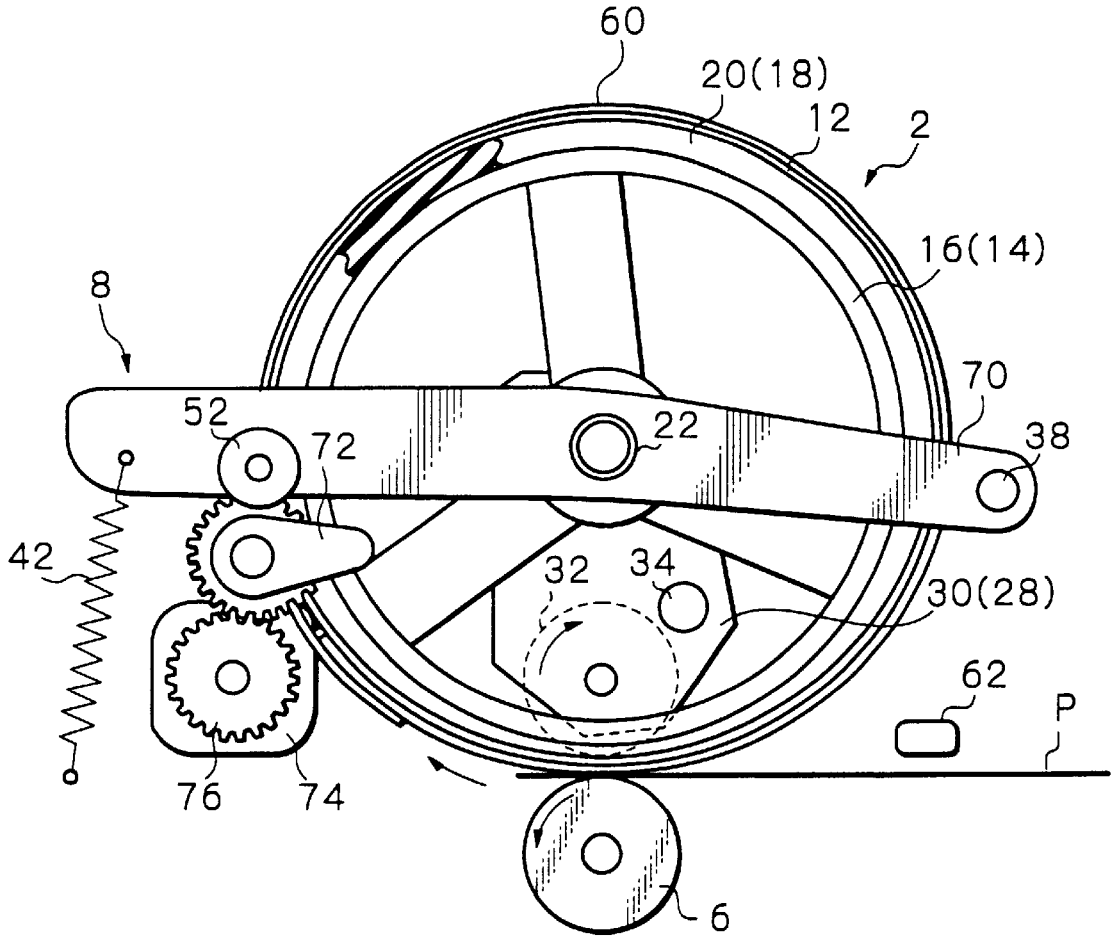
FIG. 9 is a front view showing the embodiment of FIG. 8 having started a printing operation.

Reference will be made to FIGS. 8 and 9 for describing an alternative embodiment of the present invention. As shown in FIG. 8, the ink drum 2 is not provided with the clamper 26. The master 60 is cut off at a length greater than the circumferential length of the ink drum 2. When the master 60 is wrapped around the ink drum 2, the trailing edge 60*b* of the master 60 is laid on the leading edge 60*a* of the master 60, but does not reach a position where a perforated image begins.

More specifically, the master 60 has a first non-perforated portion, a perforated portion, a second non-perforated portion and a perforated image portion, as named from the leading edge 60*a* to the trailing edge 60*b*. The trailing edge 60*b* laid on the leading edge 60*a* extends to the second non-perforated portion. The master 60 is wrapped around the ink drum 2 with its first and second non-perforated portions being pressed by master press rollers adjoining the ink drum 2; the rollers do not press the perforated portion or the perforated image portion. In this condition, the ink oozes out via the perforated portion and causes the superposed portions of the master 60 to intimately contact each other due to viscosity. For this kind of scheme, reference may be made to Japanese Patent Application No. 10-88806 mentioned earlier. The perforated portion is used for the above purpose.

The superposed portions of the master 60 intimately contacting each other due to the viscosity of the ink prevent the master 60 from moving or creasing and are therefore comparable with the clamper 26 in function. When the clamper 26 is absent, a tensile force acts on the master 60 when the paper P is peeled off due to the viscosity of the ink and is apt to dislocate or crease the master 60. The leading edge 60*a* and trailing edge 60*b* of the master 60 superposed on each other obviate such an occurrence.

In the illustrative embodiment, each moving means 8 mainly consists of an arm 70, a gear cam 72 for driving the arm 70 via a cam follower 52, and a motor 74 and a drive gear 76 for rotating the gear cam 72. The moving means 8 does not include the arrangement for locking the arm 70.

FIG. 8 shows the ink drum 2 held in its stand-by state. As shown, the gear cam 72 maintains the arm 70 i a raised position and thereby maintains the ink drum 2 spaced from the press roller 6.

When the paper sensor 62 senses the leading edge of the paper P, the motor 74 is turned on to start rotating the gear cam 72. As shown in FIG. 9, as the gear cam 72 is further rotated, the arm 70 rotates downward about the shaft 38 under the action of the spring 42 and causes the ink drum 2 to start contacting the press roller 6. The paper P is brought to the nip between the ink drum 2 and the press roller 6 at the time when the ink drum 2 contacts the press roller 6.

When the gear cam 72 is further rotated, the cylindrical portions of the ink drum 2 including the porous support 12 is brought into contact with and positioned by the press roller 6. Consequently, the annular elastic members 18 and 20 are compressed and vary the dimension of the above cylindrical portion. The ink roller 32 is therefore displaced in the direction perpendicular to the shaft 22 until it contacts the inner periphery of the ink drum 2. The resulting friction acting between the ink roller and the ink drum 12 causes the ink roller 32 to rotate in the same direction as the ink drum 2, as seen at the contact position. As a result, the ink is continuously fed from the ink roller 32 to the inner periphery of the ink drum 2.

The ink drum 2 is rotated by the drive mechanism 10, as in the previous embodiment.

While the above printing operation is under way, the gear cam 72 is held in the position shown in FIG. 9 where it does not act on the arm 70. When a plurality of papers P are continuously fed, it is not necessary to repeatedly move the ink drum 2 into and out of contact with the press roller 6, i.e., the ink drum 2 and press roller 6 are continuously held in contact with each other. This is because the illustrative embodiment does not include the clamper 26. The illustrative embodiment is therefore free from noise ascribable to the intermittent contact of the ink drum 2 and press roller 6.

When the feed of consecutive papers P is interrupted while the ink drum 2 is in rotation, the motor 74 is turned on to rotate the gear cam 72. The gear cam 72 again raises the arm 70 and thereby releases the ink drum 2 from the press roller 6. This is successful to prevent the press roller 6 from being smeared by the ink.

Further, the above configuration not using the clamper 26 simplifies the structure of the ink drum 2 and reduces the cost of the same.

Another alternative embodiment of the present invention will be described with references to FIGS. 10–13. This embodiment, also taking advantage of the effect of the annular elastic members, is capable of printing an image on one side (simplex print mode) or both sides (duplex print mode) of the paper P, as described.

Figure 10:
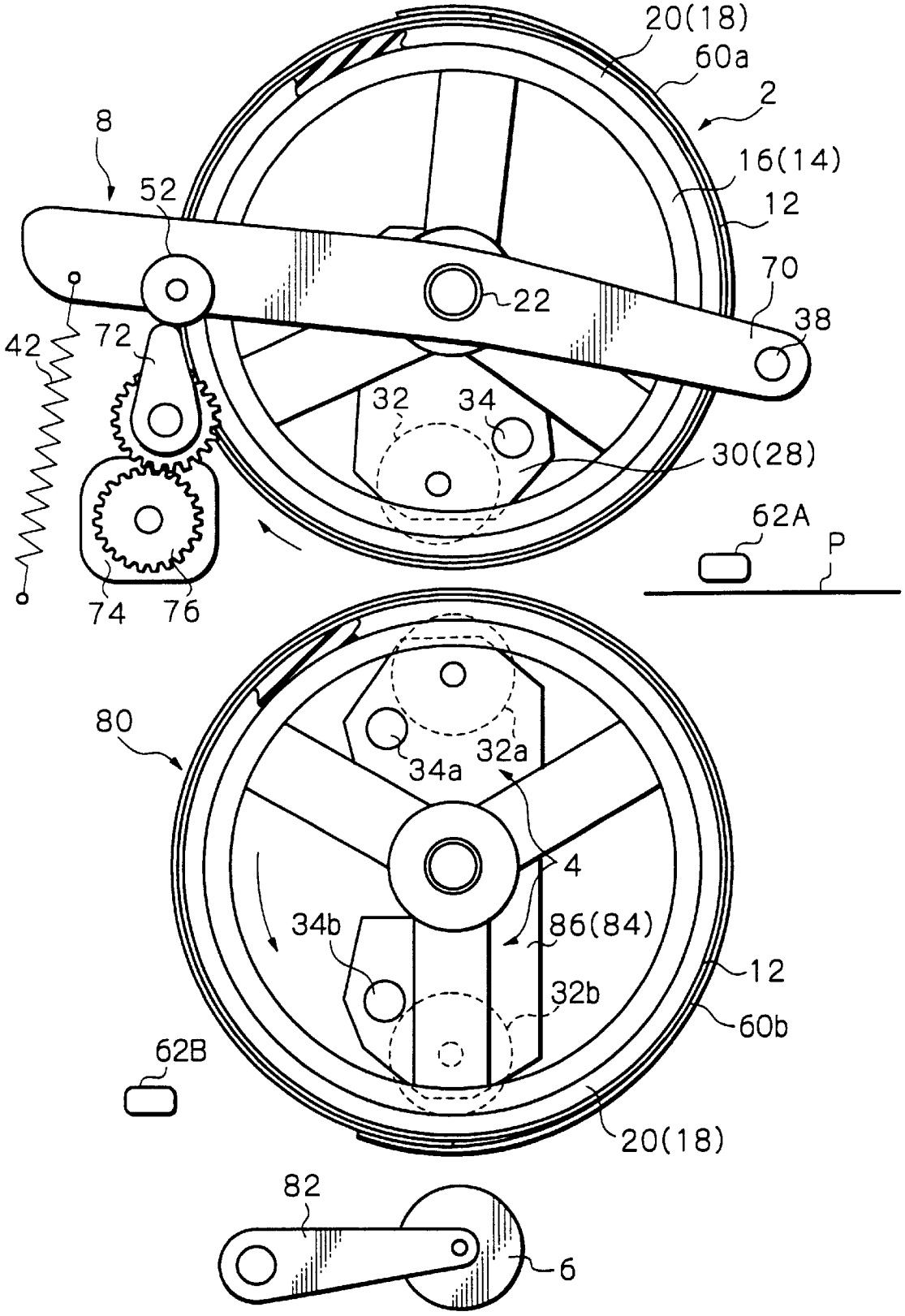
FIG. 10 is a front view showing another alternative embodiment of the present invention held in a stand-by condition in a duplex print mode.

As shown in FIG 10, an ink drum 80 identical with the ink drum 2 not including the clamper 26 is positioned below the ink drum 2. The moving means 8 moves the ink drum 2 into and out of contact with the ink drum 80. The press roller 6 is positioned below the ink drum 80 and moved into and out of contact with the ink drum 80 by moving means 82. A paper sensor 62B identical with the paper sensor 62A is positioned in the vicinity of the ink drum 80.

The ink feeding means 4 arranged in the ink drum 80 includes brackets 84 and 86 each extending in the up-and-down direction. The brackets 84 and 86 support an upper ink roller 32*a* and an upper doctor roller 34*a* on their upper portions and support a lower ink roller 32*b* and a lower doctor roller 34*b* on their lower portions.

Figure 11:
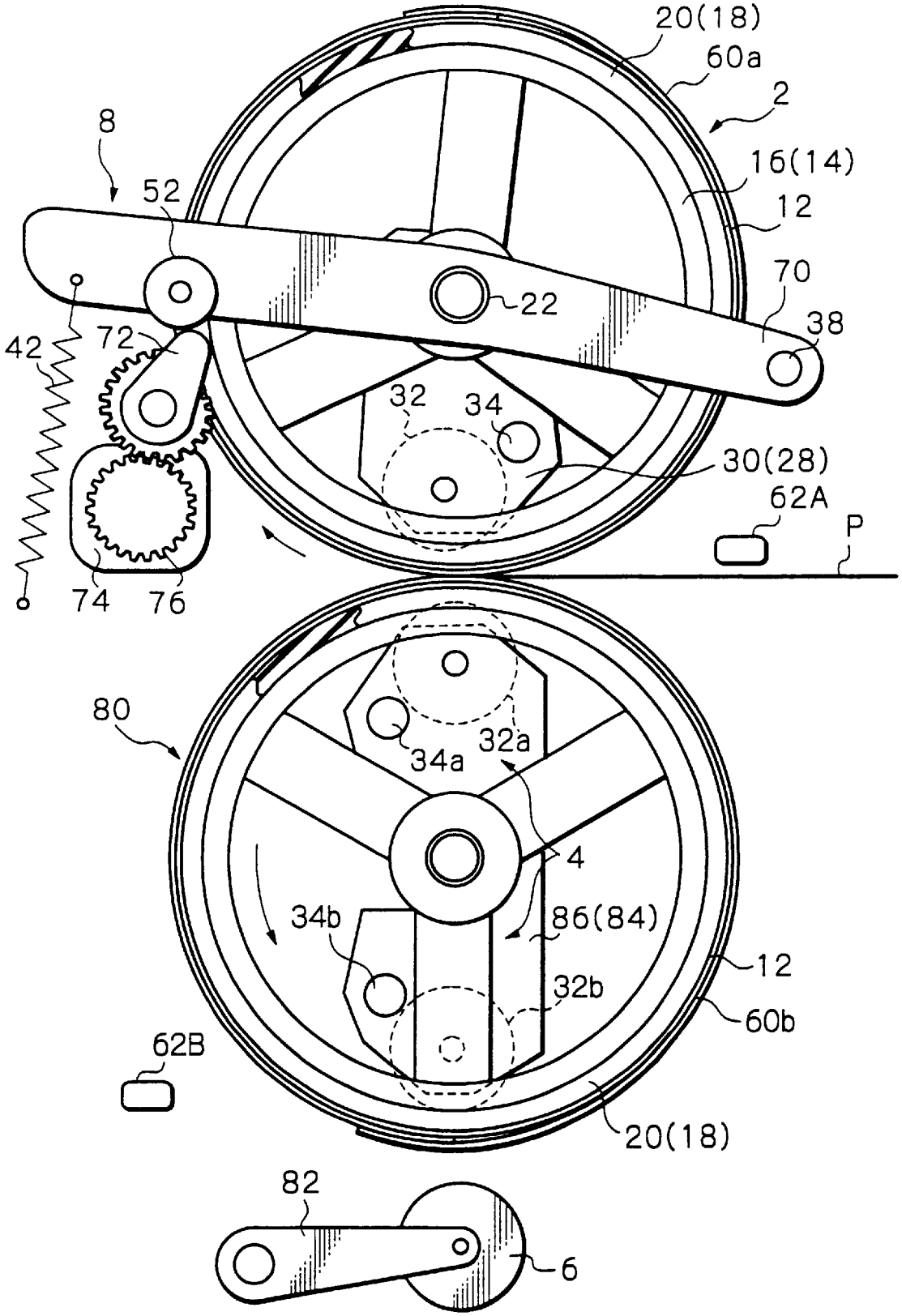
FIG. 11 is a front view showing the embodiment of FIG. 10 which is about to start a printing operation in the duplex print mode.

FIG. 11 demonstrates a duplex print mode operation available with the illustrative embodiment. As shown, when the paper sensor 62A senses the leading edge of the paper P, the motor 74 is turned on to rotate the gear cam 72. As the gear cam 72 is rotated, the arm 70 rotates downward about the shaft 38 under the action of the spring 42 and causes the ink drum 2 to start contacting the press roller 6. The paper P is brought to the nip between the ink drum 2 and the ink drum 80 at the time when the ink drum 2 contacts the ink drum 80.

Figure 12:
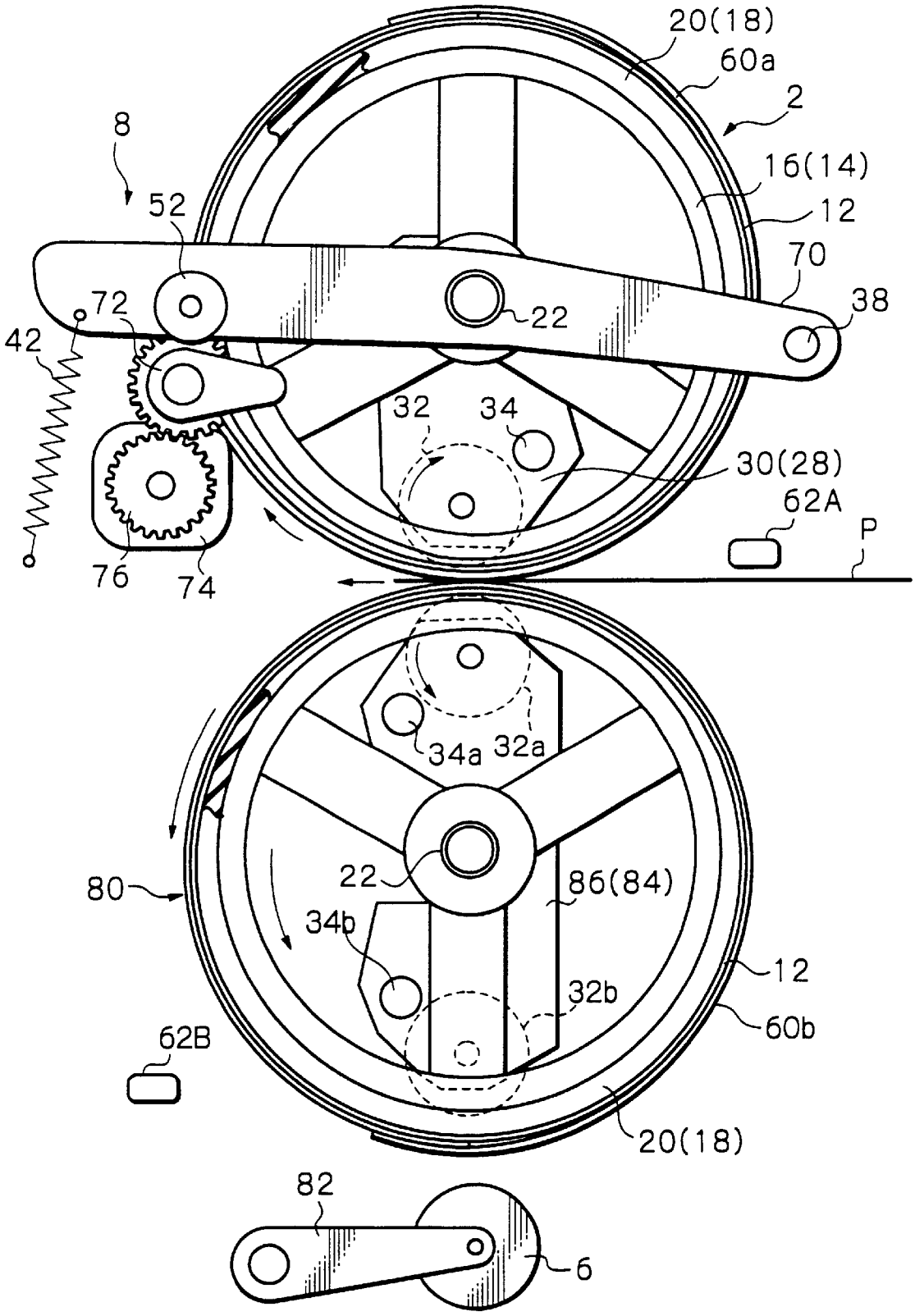
FIG. 12 is a front view showing the embodiment of FIG. 10 having started a printing operation in the duplex print mode.

As shown in FIG. 12, as the gear cam 72 is further rotated, the cylindrical portion of the ink drum 2 including the porous support 12 is brought into contact with and positioned by the ink drum 80. Consequently, the annular elastic members 18 and 20 of the ink drum 2 are compressed with the result that the ink roller 32 is displaced in the direction perpendicular to the shaft 22 until it uniformly contacts the inner periphery of the ink drum 2.

In parallel with the above displacement of the ink drum 2, the cylindrical portion of the drum 80 including the porous support 12 is pressed by the drum 2. Consequently, the annular elastic members 18 and 20 of the ink drum 80 are compressed with the result that the cylindrical portion is displaced in the direction perpendicular to the shaft 22 until its inner periphery uniformly contacts the upper ink roller 32*a*. At this instant, the lower ink roller 32*b* does not contact the inner periphery of the ink drum 80. In this condition, the ink drum 2 prints an image on one side (front) of the paper P via a master 60*a* wrapped therearound. At the same time, the ink drum 80 prints an image on the other side (rear) of the paper P via a master 60*b* wrapped therearound.

The ink drums 2 and 80 are each caused to rotate by the drive mechanism 10, as in the previous embodiments.

Figure 13:
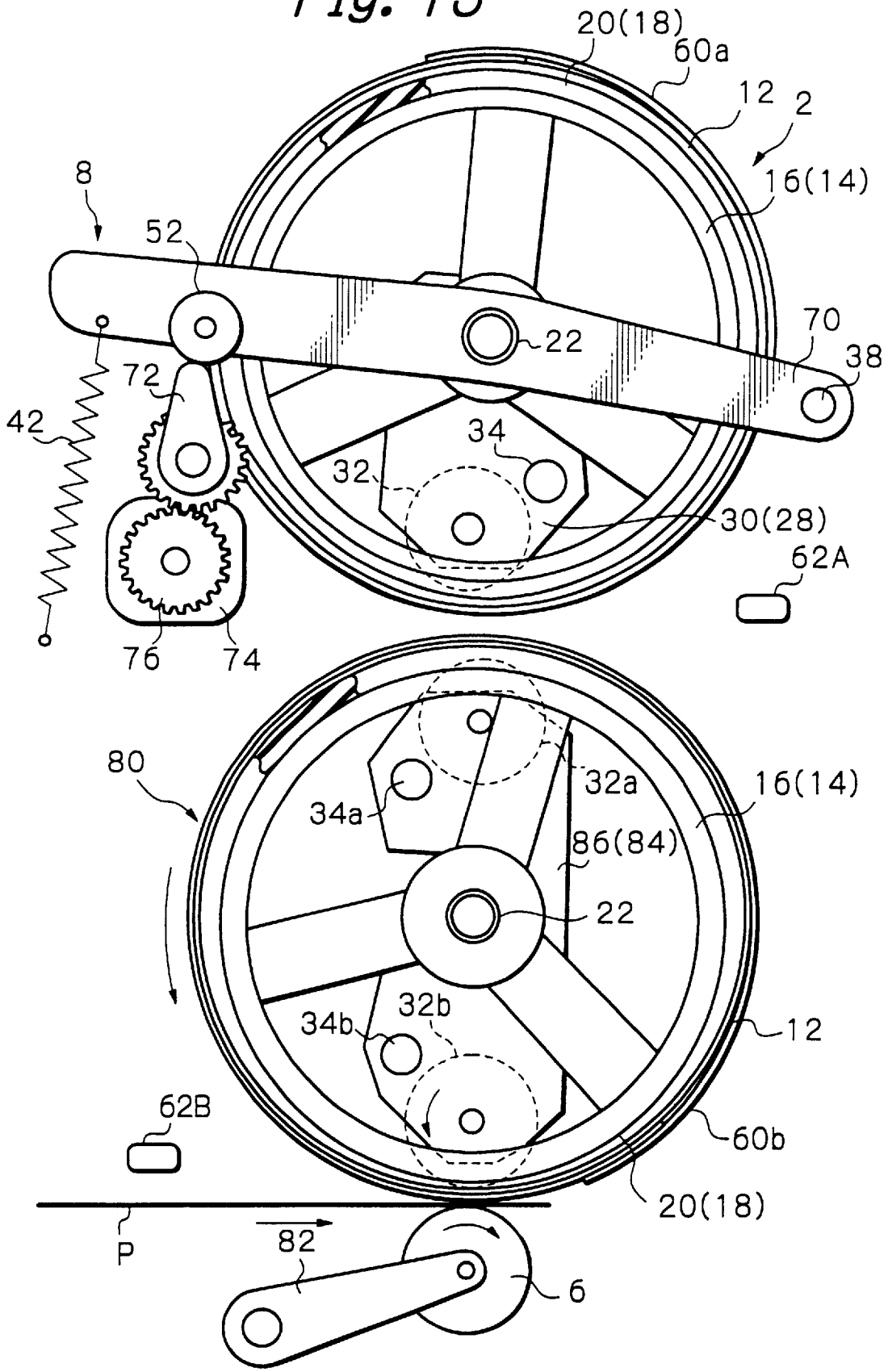
FIG. 13 is a front view showing the embodiment of FIG. 10 in a simplex print mode.

FIG. 13 shows a simplex print mode operation also available with the illustrative embodiment. As shown, in the simplex mode, the lower ink drum 80 and press roller 6 are used while the paper P is fed from the left to the right, as seen in FIG. 13. When the paper sensor 62B senses the paper P, the moving means 82 moves the press roller 6 upward and causes it to contact the outer periphery of the ink drum 80. The paper P is brought to the nip between the ink drum 80 and the press roller 6 when the ink drum 80 and press roller 6 contact each other. As the press roller 6 is further pressed against the ink drum 80, the elastic members 18 and 20 of the ink drum 80 are compressed with the result that the cylindrical portion of the drum 80 is displaced in the direction perpendicular to the shaft 22. Consequently, the inner periphery of the above cylindrical portion evenly contacts the lower ink roller 32*b*, thereby printing an image on one side of the paper P.

The ink drum 80, like the ink drum 2 of FIG. 9, does not include the clamper 26 and therefore realizes low-noise operation when papers P are continuously fed.

Figure 14:
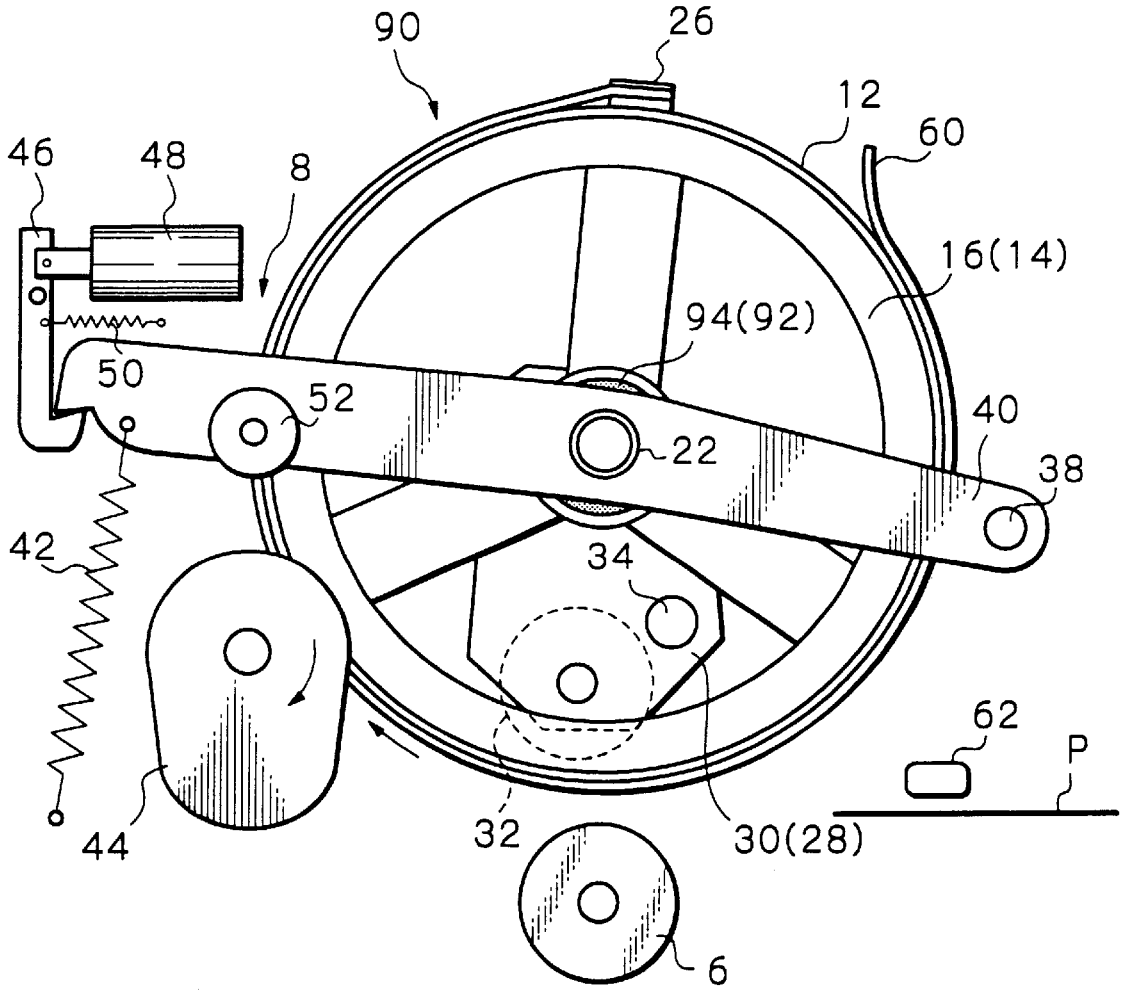
FIG. 14 is a fragmentary front view showing still another alternative embodiment of the present invention.
Figure 15:
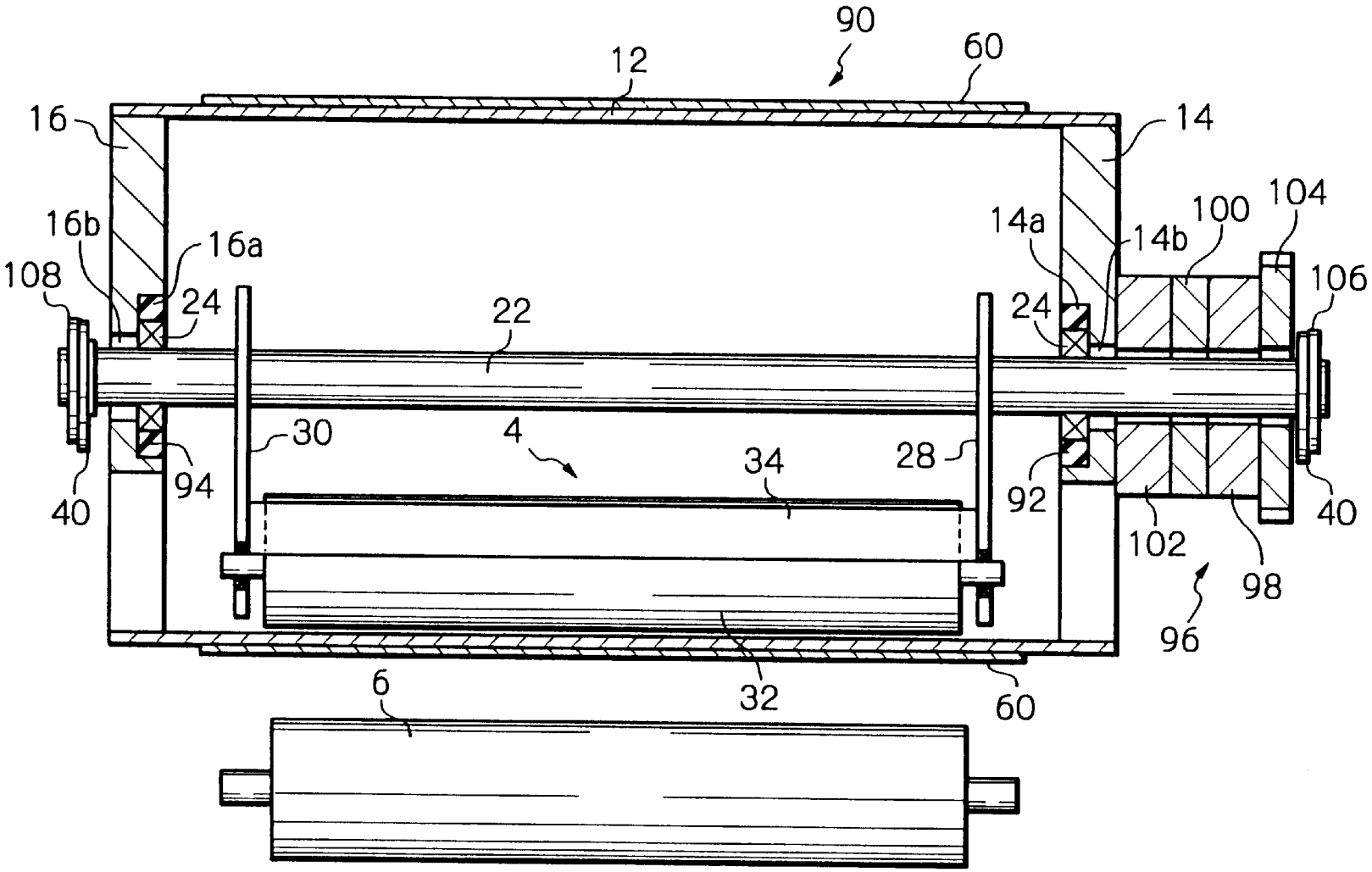
FIG. 15 is a sectional side elevation showing an ink drum included in the embodiment of FIG. 14.

Still another alternative embodiment of the present invention will be described with reference to FIGS. 14–18. This embodiment differs from the previous embodiments as to the positions of the elastic members. As shown, an ink drum 90 includes the porous support 12 directly connected to the flanges 14 and 16. As shown in FIGS. 14 and 15, elastic members 92 and 94 implemented as moldings are respectively positioned between the outer circumference of the bearings 24 and the flanges 14 and 16. More specifically, the portions of the flanges 14 and 16 facing the bearings 24 each are removed in an annular configuration. The elastic members 92 and 94 are respectively fitted in the resulting annular recesses 14*a* and 16*a* of the flanges 14 and 16. The elastic members 92 and 94 are formed of the same materials as the elastic members 18 and 20.

Figure 16:
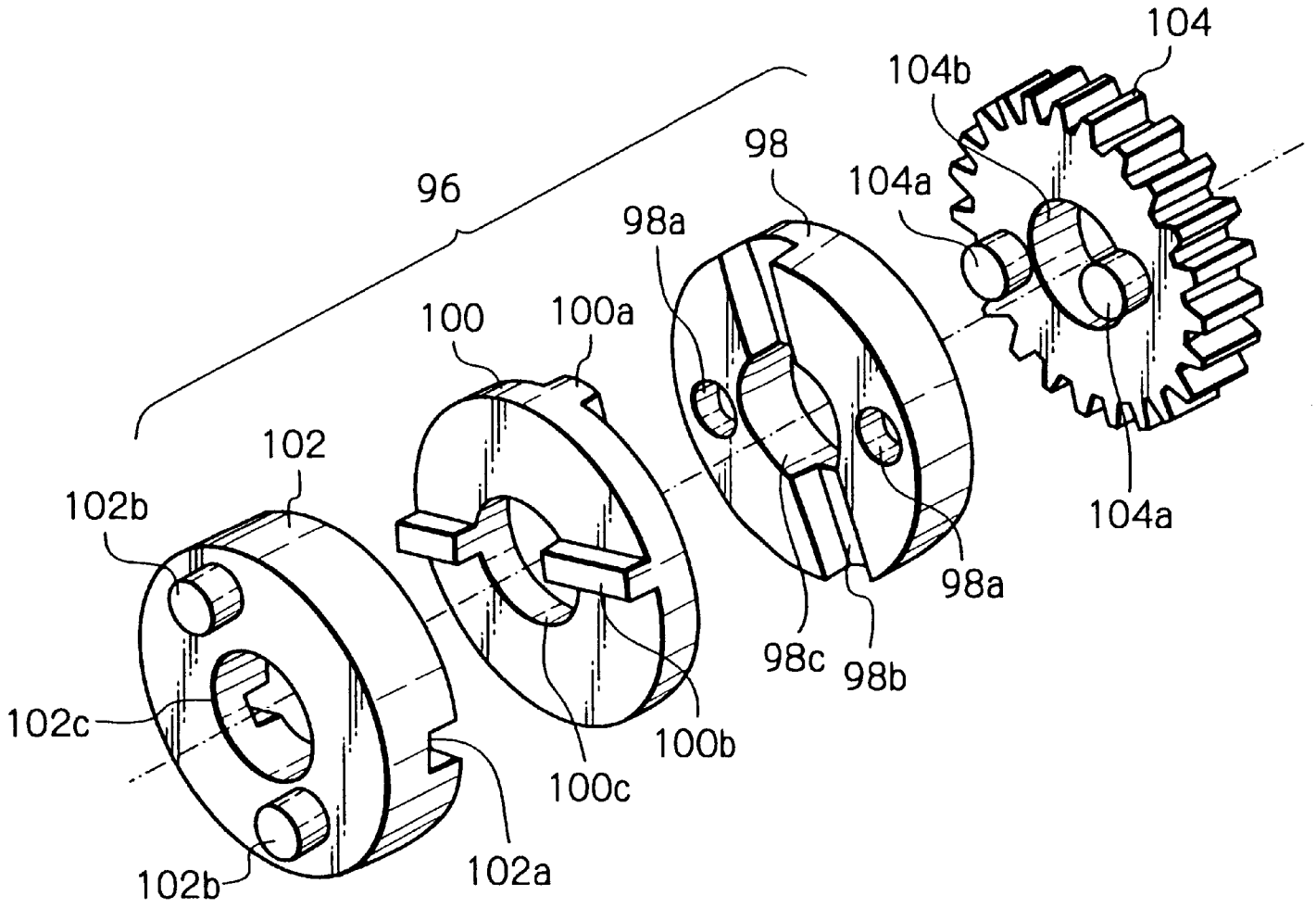
FIG. 16 is a perspective view of joint means also included in the embodiment of FIG. 14.

In the above configuration, the center of the shaft 22 and the aligned centers of the flanges 14 and 16 are deviated from each other due to the deformation of the elastic members 92 and 94. To allow the ink drum 90 to rotate despite such deviation, the illustrative embodiment additionally includes joint means 96. As shown in FIGS. 15 and 16, the joint means 96 is made up of a first joint 98, an intermediate joint 100, and a second joint 102.

The drive mechanism for rotating the ink drum 90, like the drive mechanism of the embodiment shown in FIGS. 2–4, includes a gear 104 formed with a pair of lugs 104*a*. The first joint 98 is formed with a pair of holes 98*a* aligning with the lugs 104*a*. The gear 104 is rotatable integrally with the first joint 98 with the lugs 104*a* mating with the holes 98*a*. A diametrical groove 98*b* is formed in the side of the first joint 98 opposite to the side facing the gear 104. A diametrical ridge 100*a* is formed on the side of the intermediate groove 100 facing the first joint 98 and is capable of mating with and sliding in the groove 98*b*.

A diametrical ridge 100*b* is formed on the other side of the intermediate joint 100 perpendicularly to the ridge 100*a*. A diametrical groove 102*a* is formed in one side of the second joint 102 and capable of slidably receiving the ridge 100*b*. A pair of lugs 102*b* are formed on the other side of the second joint 102. The second joint 102 is affixed to the center of the flange 14 via the lugs 102*b*.

Center holes 98*c*, 100*c*, 102*c* and 104*b* are formed in the first joint 98, intermediate joint 100, second joint 102 and gear 104, respectively. The center holes 98*c*–104*b* each are sized to accommodate the deformation of the elastic members 92 and 94. Likewise, the flanges 14 and 16 are respectively formed with openings 14*b* and 16*b* sized to accommodate the deformation of the elastic members 92 and 94. As shown in FIG. 15, the opposite arms 40 are mounted on the shaft 22 via bearings 106 and 108, respectively.

The above stencil printer is operated as follows. FIG. 14 shows the ink drum 90 held in a stand-by state with the master 60 being wrapped therearound. In this condition, the arm 40 is locked by the lock lever 46. When the paper sensor 62 senses the leading edge of the paper P, the solenoid 48 is turned on to retract the lock lever 46 with the result that the arm 40 is unlocked, as in the embodiment shown in FIGS. 2–4.

Figure 17:
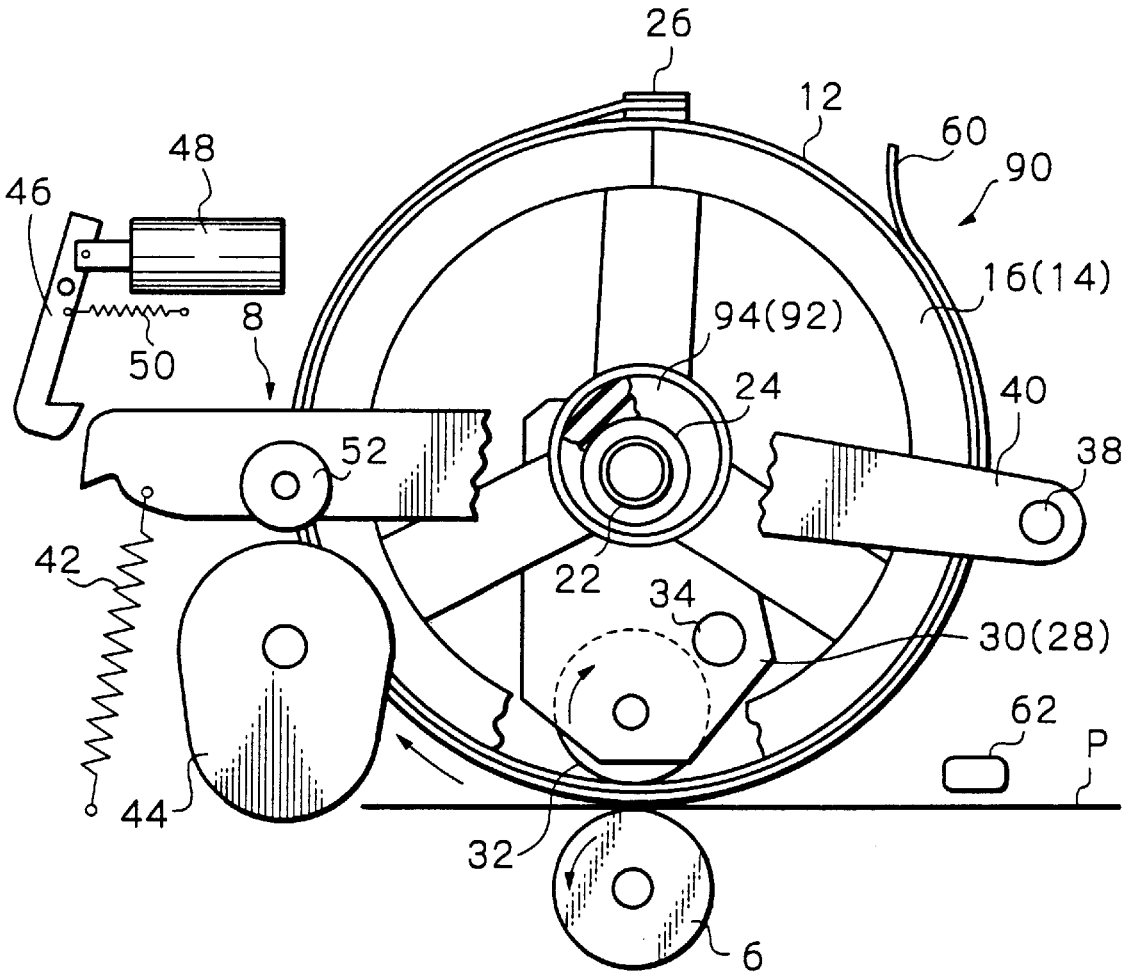
FIG. 17 is a front view showing the embodiment of FIG. 14 in a printing condition.
Figure 18:
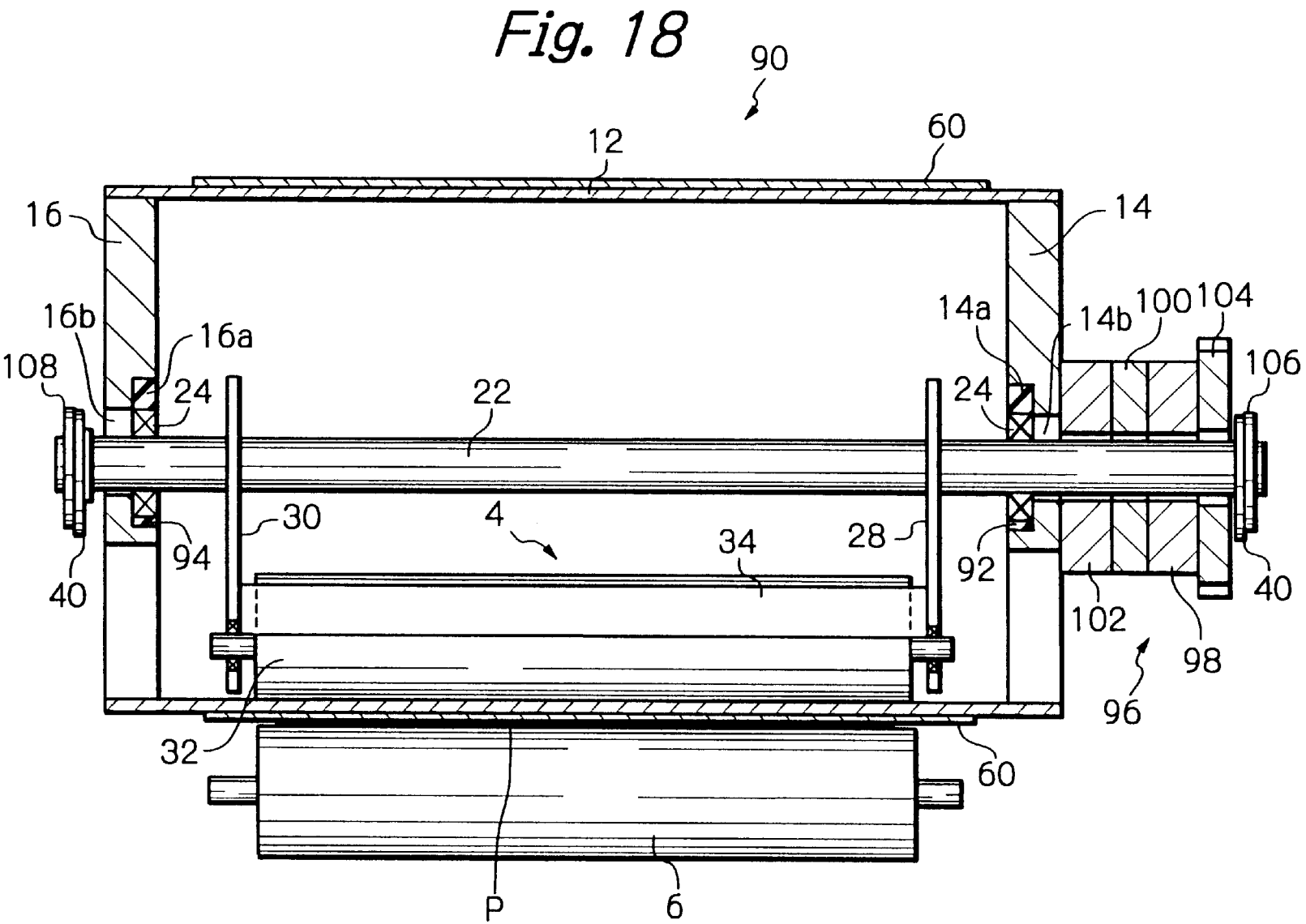
FIG. 18 is a sectional side elevation showing the same condition as FIG. 17.

As shown in FIGS. 17 and 18, when the ink drum 90 and cam 44 are further rotated, the arm 40 rotates downward about the shaft 38 under the action of the spring 42 and causes the ink drum 90 to start contacting the press roller 6. As the cam 44 is further rotated, the cylindrical portion of the ink drum 90 including the porous support 12 is brought into contact with and positioned by the press roller 6. Consequently, the annular elastic members 92 and 94 are compressed and vary the dimension of the above cylindrical portion. The ink roller 32 is therefore displaced in the direction perpendicular to the shaft 22 until it contacts the inner periphery of the ink drum 90.

The deformation of the elastic members 92 and 94 due to compression brings the center of the shaft 22 and the centers of the flanges 14 and 16 out of alignment. However, the rotation of the gear 104 is transferred to the second joint 102 on the basis of the principle of an Oldham joint and drives the flange 14. This allows the ink drum 90 to rotate.

In the illustrative embodiment, the elastic members 92 and 94 each are reduced in volume and therefore in cost, compared to the previous embodiments.

Figure 19:
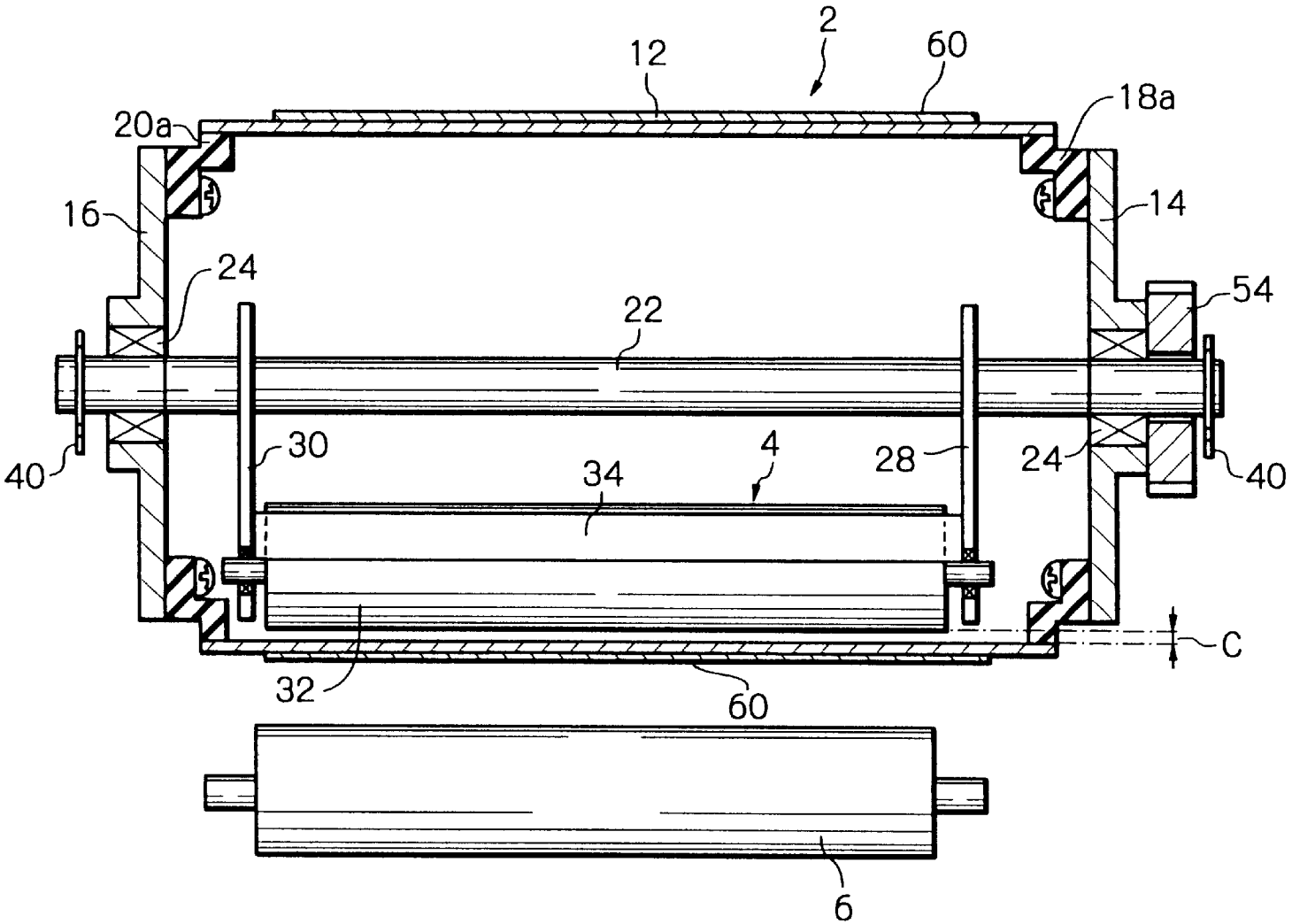
FIG. 19 is a side elevation showing a further alternative embodiment of the present invention.

Referring to FIG. 19, a further alternative embodiment of the present invention is shown. This embodiment, like the embodiment shown in FIGS. 14–18, is unique in the location of the elastic members. As shown, the ink drum 2 includes annular elastic members 18*a* and 20*a* also implemented as moldings. The elastic members 18*a* and 20*a* are respectively affixed between the inner surfaces of the flanges 14 and 16 and the inner periphery of the porous support 12. The elastic members 18*a* and 20*a* each are generally configured in the form of a letter L. As for a material, the elastic members 18*a* and 20*a* are identical with the elastic members 18 and 20.

Because this embodiment does not use the deformation of the elastic members 18 and 20, FIG. 3, based on collapse, it can use elastic members having relatively high hardness, e.g., above 50 in terms of rubber hardness. This, coupled with the fact that even such elastic members are displaceable by a preselected amount, enhances durability and accurate rotation in the drive transmission from the flanges 14 and 16 to the support 12.

Moreover, when this embodiment is applied to the embodiment of FIG. 12 including two ink drums arranged one above the other, a sufficient margin is available as to the collision of the flanges of the two drums and insures stable image quality.

In summary, it will be seen that the present invention provides a stencil printer having various unprecedented advantages, as enumerated below.

(1) An ink roller and a porous support 1 included in an ink drum are displaceable independently of each other on the basis of the elasticity of elastic members. Therefore, uniform pressure is allowed to act between the ink roller and the inner periphery of the ink drum. This solves the irregular image density and roll-up problems without reducing the rigidity of the ink drum.

(2) When the above pressure does not act, the elastic members play the role of spacers for freeing a displaceable configuration from shaking and achieving vibration resistance.

(3) The elastic members are implemented as annular moldings which are easily to fabricate.

(4) Because the ink drum is moved into and out of contact with a pressing member, the weight of the ink drum itself is used and reduces the size of the source of a pressing force.

Various modifications will become possible for those skilled in the art after receiving the teachings of the present disclosure without departing from the scope thereof.

What is claimed is:

1. A stencil printer comprising:

a rotatable ink drum including a hollow cylindrical porous support and supported by a shaft;

an ink roller disposed in said rotatable ink drum;

a pressing member positioned outside of said rotatable ink drum and facing said ink roller, said pressing member being configured to press a paper against said rotatable ink drum; and a plurality of elastic members configured to displace said hollow cylindrical porous support independently of said ink roller and the shaft supporting said rotatable ink drum.

2. A stencil printer as claimed in claim 1, further comprising a pair of flanges mounted on said shaft and spaced from each other for supporting opposite ends of said hollow cylindrical porous support, said plurality of elastic members being respectively positioned between outer circumferences of said pair of flanges and an inner periphery of said hollow cylindrical porous support.

3. A stencil printer as claimed in claim 2, wherein said plurality of elastic members comprises rubber.

4. A stencil printer as claimed in claim 3, wherein said plurality of elastic members each comprises an annular molding.

5. A stencil printer as claimed in claim 4, further comprising moving means for selectively moving said rotatable ink drum into or out of contact with said pressing member.

6. A stencil printer as claimed in claim 2, wherein said plurality of elastic members comprises a foam plastic.

7. A stencil printer as claimed in claim 6, wherein said plurality of elastic members each comprises an annular molding.

8. A stencil printer as claimed in claim 7, further comprising moving means for selectively moving said rotatable ink drum into or out of contact with said pressing member.

9. A stencil printer as claimed in claim 2, further comprising moving means for selectively moving said rotatable ink drum into or out of contact with said pressing member.

10. A stencil printer as claimed in claim 1, further comprising a pair of flanges mounted on said shaft and spaced from each other for supporting opposite ends of said hollow cylindrical porous support, said plurality of elastic members being respectively positioned between said pair of flanges and said shaft.

11. A stencil printer as claimed in claim 10, wherein said plurality of elastic members comprises rubber.

12. A stencil printer as claimed in claim 11, wherein said plurality of elastic members each comprises an annular molding.

13. A stencil printer as claimed in claim 12, further comprising moving means for selectively moving said rotatable ink drum into or out of contact with said pressing member.

14. A stencil printer as claimed in claim 10, wherein said plurality of elastic members comprises a foam plastic.

15. A stencil printer as claimed in claim 14, wherein said plurality of elastic members each comprises an annular molding.

16. A stencil printer as claimed in claim 15, further comprising moving means for selectively moving said rotatable ink drum into or out of contact with said pressing member.

17. A stencil printer as claimed in claim 10, further comprising moving means for selectively moving said rotatable ink drum into or out of contact with said pressing member.

18. A stencil printer as claimed in claim 1, further comprising a pair of flanges mounted on said shaft and spaced from each other for supporting opposite ends of said hollow cylindrical porous support, said plurality of elastic members being respectively positioned between inner surfaces of said pair of flanges and said hollow cylindrical porous support.

19. A stencil printer as claimed in claim 18, wherein said plurality of elastic members comprises rubber.

20. A stencil printer as claimed in claim 19, wherein said plurality of elastic members each comprises an annular molding.

21. A stencil printer as claimed in claim 20, further comprising moving means for selectively moving said rotatable ink drum into or out of contact with said pressing member.

22. A stencil printer as claimed in claim 18, wherein said plurality of elastic members comprises a foam plastic.

23. A stencil printer as claimed in claim 22, wherein said plurality of elastic members each comprises an annular molding.

24. A stencil printer as claimed in claim 23, further comprising moving means for selectively moving said rotatable ink drum into or out of contact with said pressing member.

25. A stencil printer as claimed in claim 18, further comprising moving means for selectively moving said rotatable ink drum into or out of contact with said pressing member.

26. A stencil printer as claimed in claim 1, wherein said plurality of elastic members comprises rubber.

27. A stencil printer as claimed in claim 26, wherein said plurality of elastic members each comprises an annular molding.

28. A stencil printer as claimed in claim 27, further comprising moving means for selectively moving said rotatable ink drum into or out of contact with said pressing member.

29. A stencil printer as claimed in claim 1, wherein said plurality of elastic members comprises a foam plastic.

30. A stencil printer as claimed in claim 29, wherein said plurality of elastic members each comprises an annular molding.

31. A stencil printer as claimed in claim 30, further comprising moving means for selectively moving said rotatable ink drum into or out of contact with said pressing member.

32. A stencil printer as claimed in claim 1, further comprising moving means for selectively moving said rotatable ink drum into or out of contact with said pressing member.

33. A stencil printer as claimed in claim 1, wherein said pressing member comprises a pressing roller.

34. A stencil printer comprising:

a rotatable ink drum including a hollow cylindrical porous support and supported by a shaft;

an ink roller disposed in said rotatable ink drum;

pressing means for pressing a paper against said rotatable ink drum; and elastic means for displacing said hollow cylindrical porous support independently of said ink roller and the shaft supporting said rotatable ink drum.

* * * * *